United States Patent [19]

Schlake

[11] Patent Number: 4,818,191

[45] Date of Patent: Apr. 4, 1989

[54] DOUBLE-ACTING DIAPHRAGM PUMP SYSTEM

[75] Inventor: Bernard H. Schlake, Cincinnati, Ohio

[73] Assignee: Neyra Industries, Inc., Cincinnati, Ohio

[21] Appl. No.: 640,556

[22] Filed: Aug. 15, 1984

Related U.S. Application Data

[63] Continuation of Ser. No. 364,473, Mar. 31, 1982, abandoned.

[51] Int. Cl.[4] ..... F04B 43/06

[52] U.S. Cl. ..... 417/390; 417/397; 91/275

[58] Field of Search ..... 417/395, 397, 390, 403, 417/404; 91/275, 361; 239/390, 550; 92/858

[56] References Cited

U.S. PATENT DOCUMENTS

| | | | |
|---|---|---|---|
| 2,135,721 | 11/1938 | Landenberger | 417/397 |
| 2,555,046 | 5/1951 | Livers et al. | 91/361 |
| 2,723,882 | 11/1955 | Barnett | 239/550 |
| 2,799,444 | 7/1957 | Schemmel | 417/397 X |
| 3,249,053 | 5/1966 | Govan | 417/397 X |
| 3,489,063 | 1/1970 | Piret | 91/275 |
| 3,741,692 | 6/1973 | Rupp | 417/540 |
| 4,339,233 | 7/1982 | Krueger | 417/900 X |
| 4,373,864 | 2/1983 | Massey et al. | 417/46 |

FOREIGN PATENT DOCUMENTS

| | | | |
|---|---|---|---|
| 48107 | 4/1977 | Japan | 417/397 |

*Primary Examiner*—Leonard E. Smith

*Attorney, Agent, or Firm*—Shlesinger & Myers

[57] ABSTRACT

A double-acting diaphragm pump system for pumping and spraying materials, particularly corrosive liquids and abrasive fluids. The system includes a hydraulically driven double-acting diaphragm pmup which is electrically controlled for alternately pumping material through the dual pump chambers to an outlet pipe. The diaphragms of the double-acting pump are moved back and forth by a dual-acting hydraulic cylinder powered by a hydrostatic transmission for providing automatic response to pumped fluid needs, coupled with overpressure protection. An expansion tank maintains a constant pressure on the fluid as it is discharged from the pump. The system is capable of spraying abrasive slurries of a wide variety, at an even spray pattern, as the system wears, and hardened wear rings around the inlet and outlet valves permit the pump to be inexpensively rebuilt after extended use pumping abrasive slurries.

9 Claims, 2 Drawing Sheets

DOUBLE-ACTING DIAPHRAGM PUMP SYSTEM

This application is a continuation of application Ser. No. 364,473, filed Mar. 31, 1982, now abandoned.

BACKGROUND OF THE INVENTION

The use of diaphragm pumps to move or propel fluids, slurries, or the like, from one location to another, is well-known. The multiple diaphragms are customarily actuated by compressed air or hydraulic fluid, the diaphragms being connected by a common shaft, whereby the diaphragms move simultaneously in a parallel path. Diaphragm movement is conventionally powered by compressed air, as described in U.S. Pat. No. 3,338,171, or by hydraulic fluid, as described in U.S. Pat. Nos. 2,625,886, 3,652,187, 3,791,768 and 3,976,401. In accordance with the teachings of these patents, air or hydraulic fluid is directed against a side of a diaphragm of one chamber while air or hydraulic fluid is exhausted from behind the diaphragm of the other chamber. When the stroke is complete, an air or hydraulic valve automatically transfers the air or hydraulic fluid flow to the diaphragm of the second chamber, while the air or hydraulic fluid in the first chamber is exhausted. The continuous reciprocating motion of the shaft creats an alternate suction and discharge of the material in each chamber. Suction and discharge valves control the flow of material through the intake port of the pumping chambers and out the discharge port thereof.

With the prior art diaphragm pumps, where the pump is employed for spraying abrasive slurries which are conventionally employed for sealing asphalt surfaces, the spray pattern changes as the spray nozzles wear due to gradually enlarging the hole in the nozzles by the abrasive slurry, thereby producing a lower pressure drop and a smaller spray pattern.

SUMMARY OF THE INVENTION

The present invention is a double-acting diaphragm system which is particularly adapted for spraying corrosive liquids, abrasive slurries, or the like, which system is simple, efficient, durable, and adapted to maintain a constant pressure of the sprayed material even after long usage and wear of the parts. The equipment is selectively stationary or portable, and the components thereof are relatively inexpensive and easy to maintain.

In the dual-acting diaphragm system of the present invention, the pumped fluids discharge pressure is maintained constant automatically even though pumping conditions vary drastically, as in the case of spraying abrasive slurries. With the system of the present invention, the pump automatically responds to the "set" pressure, thus maintaining the correct spray pattern by automatically increasing pumped fluid discharge volume.

In the dual-acting diaphragm pump system of the present invention, the dual-acting hydraulic cylinder that drives the diaphragms automatically switches back and forth by means of microswitches located at each end of the cylinder. These switches signal an electrically operated directional control valve which switches the hydraulic fluid from one end of the hydraulic cylinder to the other. the electrical circuitry of the present system being considerably simpler than that employed in U.S. Pat. No. 3,976,401, and the microswitches being totally isolated from the pumped fluids. With the present systems also, "weep" holes are provided in the chambers in order to avoid inoperability of the pump caused by leaking fluids. It is further a salient feature of the present invention to provide an expansion tank above the outlet pipe from the pump which effectively minimizes fluctuations in pumped fluid pressure during the pumping operation.

The dual-acting diaphragm pump system of the present invention further includes hardened, replaceable spray nozzles, and wear rings around both inlet and outlet valves, the parts of the pump system which are particularly susceptible to wear from pumping abrasive slurries.

The present pump is adapted to receive solids up to ¾" in diameter and, if one diaphragm is ruptured, the pump can continue to operate using the remaining diaphragm.

DETAILED DESCRIPTION OF THE INVENTION

Figure 1:
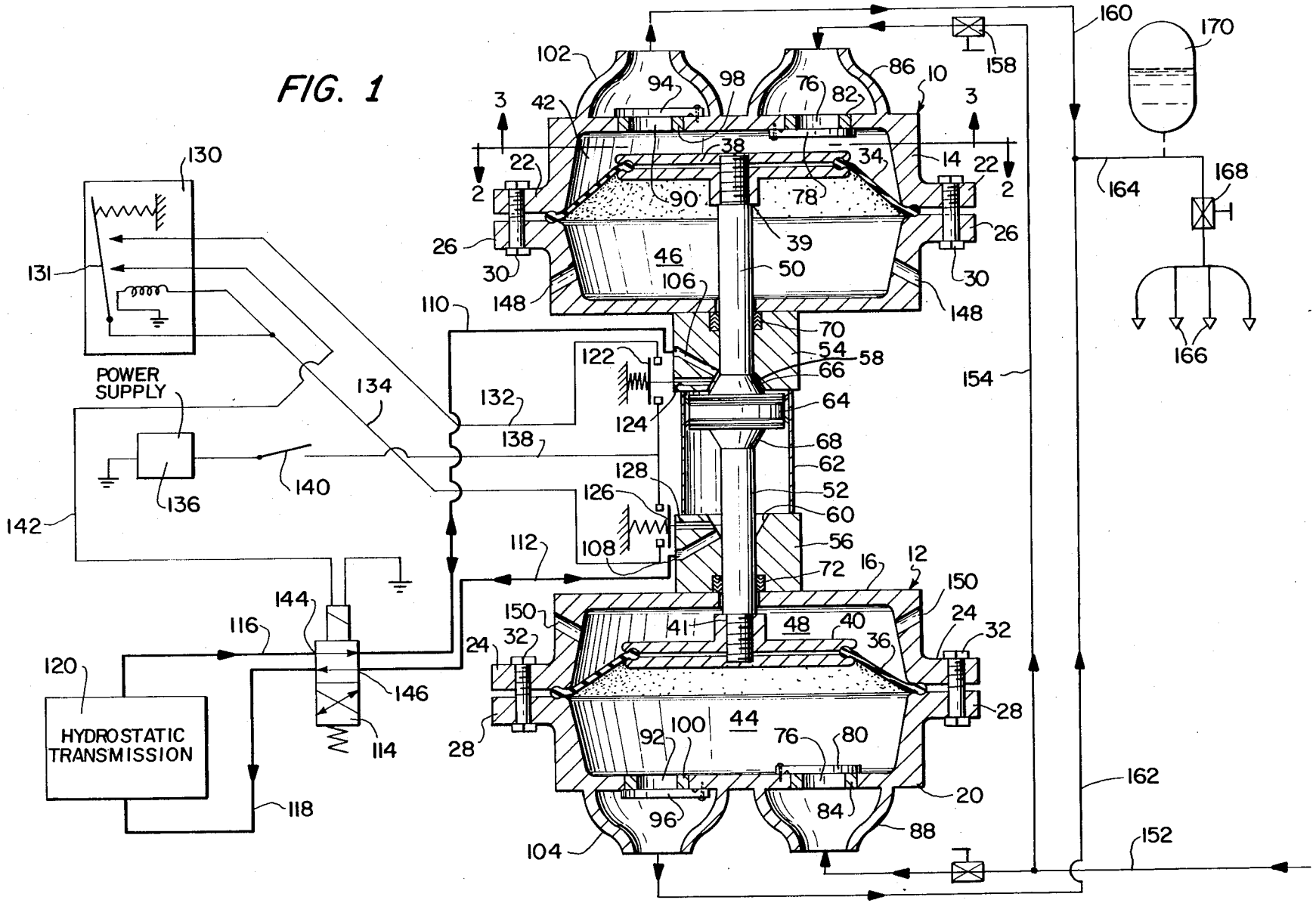
FIG. 1 is a schematic view of the double-acting diaphragm pump system of the present invention, showing the pump in section.
Figure 3:
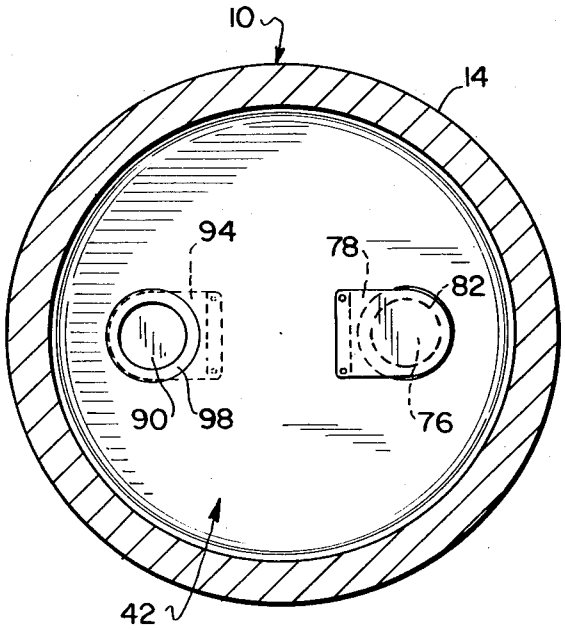
FIG. 3 is a sectional view taken along the line 3—3 of FIG. 1, looking in the direction of the arrows.
Figure 2:
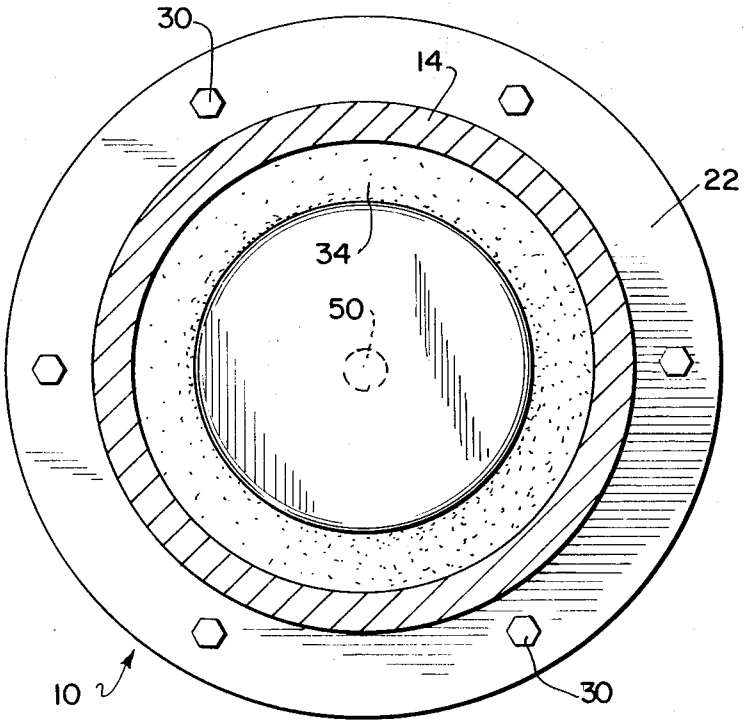
FIG. 2 is a sectional view taken along the line 2—2 of FIG. 1, looking in the direction of the arrows.

Referring now to FIG. 1, the dual-acting diaphragm pump system of the present invention includes a pair of spaced pump housings 10 and 12 which are shown in vertically spaced relationship, but which may also be arranged in a horizontally spaced relationship if desired. Each of pump housings 10 and 12 includes an upper portion 14 and 16 and a lower portion 18 and 20, the upper portions having annular flanges 22 and 24 and the lower portions having annular flanges 26 and 28. Flanges 22 and 26 and flanges 24 and 28 are in opposed relation to each other and are connected together by a series of nut and bolt assemblies 30 and 32.

In accordance with the present invention, each of housings 10 and 12 is provided with an annular flexible diaphragm 34, 36 which extends across the central part of the housing, the outer edges of which are held between flanges 22, 26 and 24, 28. The inner circular edge of the diaphragm is held between circular diaphragm piston plates 38, 40 which divide housings 10 and 12 into pumping chambers 42, 44, and back chambers 46, 48 Pressure plates 38 and 40 are connected by, and are secured to, a single main piston shaft comprising an upper portion 50 and a lower portion 52, one end of each of which is threadedly engaged with a central portion of piston plates 38 and 40 as indicated at 39 and 41. Upper portion 50 and lower portion 52 extend through central openings in stationary bases 54, 56, which openings are flared at one end, as indicated at 58, 60.

Bases 54 and 56 lie in aligne, spaced relationship and are joined by a hydraulic cylinder 62 into which upper and lower portions 50 and 52 extend. Within cylinder 62 there is provided a piston 64, the opposed faces of which are affixed to the proximate ends of main shaft portions 50 and 52 in order to provide for reciprocation of piston 64 within hydraulic cylinder 62, and corresponding movement of diaphragms 34, 36.

Main piston shaft portions 50 and 52 are enlarged at a point adjacent piston shaft 64, as indicated at 66, 68 for purposes which will be hereinafter more fully set out, the enlarged portions of the shaft being alternately received in the flared openings 58, 60 of bases 54, 56 on each stroke of the piston shaft. Bases 54 and 56 are provided with annular recesses proximate the main piston shaft in which packing 70 and 72 is positioned.

Upper portion 14 of pump housing 10 and lower portion 20 of pump housing 12 are each provided with inlet openings 74, 76 having inlet valves 78, 80. Removable and replacele annular wear rings indicated at 82, 84 are positioned in the inlet openings. Exterior orfices for the inlet openings are designated 86, 88.

In like manner, chambers 42 and 44 are also provided with outlet openings 90 and 92 and outlet valves 94 and 96. Removable and replaceable annular wear rings are indicated at 98 and 100. Exterior outlet orfices are designated 102, 104.

In accordance with one of the salient features of the present invention, there is provided a hydraulic system for operating piston 64 within cylinder 62 to actuate diaphragms 34, 36, to pump the fluid material through the dual-acting diaphragm pump. The hydraulic system includes fluid conduits 106, 108 formed in bases 54, 56. Hydraulic lines 110, 112 extend from conduits 106, 108 to an electrically controlled directional control valve 114 which controls the direction of flow of hydraulic fluid to and from conduits 106, 108 to alternate the direction of movement of piston shaft 64 in hydraulic cylinder 62. Hydraulic lines 116, 118 connect directional control valve 114 with a variable volume pump of the pressure compensated type 120. Pump 120 is of a conventional type, such as manufactured by Sperry-Vickers, Hydreco, Hydura and Sundstrand. The pressure compensated variable volume pump functions to maintain a preset, predetermined, constant pressure of the pump fluid material regardless of the variations in pumping conditions, since the pressure of the hydraulic fluid is directly related to the pressure of the pumped fluid material. The compensator on the variable volume pump can be set to automatically produce a given hydraulic fluid pressure within a certain range no matter how the conditions within the system are varied. Variable volume pump 120 is driven by an electric motor or gasoline engine (not shown) and, after leaving the pump the hydraulic fluid passes through hydraulic line 116 to directional control valve 114 which is preferably a 4-way, two position, solenoid actuated, spring return directional control valve. The hydraulic fluid proceeds through the directional control valve 114 and hydraulic line 110 to conduit 106 where it forces the main shaft portions 50 and 52 downwardly, along with diaphragm piston plates 38, 40 and diaphragms 34, 36.

To control the flow of hydraulic fluid to both sides of piston 64, there is provided an electrical control system which comprises a normally closed microswitch 122, a portion of which extends through an opening 124 in base 54, into engagement with the periphery of main shaft portion 50. In like manner, a second microswitch 126 which is normally open, extends through an opening 128 in base 56 for engagement with the periphery of main shaft portion 52. A relay 130 having a contact 131 is connected by microswitcn 122 through a line 132, and microswitch 126 is connected to the relay through an electric line 134. An electrical power supply designated 136 comprising a 12 volt D..C. or 110 volt A.C. source is connected through an electric line 138 to microswitches 122 and 126, which electric line is provided with a switch 140.

An electric line 142 also extends from relay 130 to directional control valve 114 to effect switching of hydraulic fluids from port 144 to 146 of the valve.

In accordance with the present invention also, housing portion 16 of pump housing 12 and ousing portion 18 of pump housing 10 are provided with weep or drain holes 148, 150 through which any pump fluid leaking through diaphragm 34 and 36 can flow exteriorly of the housings to avoid inoperability of the pump.

In connection with the dual-acting diaphragm pump, there are provided inlet pipes 152 and 154 for feeding the fluid to chambers 42 and 44 of pump housings 10 and 12. Housings 10 and 12 are also provided with outlet pipes 160 and 162 which are connected through a feed pipe 164 to a spray pipe having a plurality of nozzles 166. A shutoff valve 168 is located in feed pipe 164 proximate nozzles 166.

It is a salient feature of the present invention to provide an expansion tank 170, located above, and in communication with, feed pipe 164, which expansion tank acts to eliminate the majority of the drop in pumped fluid pressure. By means of this arrangement, the pumped fluid compresses the air trapped in the expansion tank and, as the pump changes direction, the pump fluid pressure drops slightly. At this time, the pressure of the compressed air is slightly higher than the pumped fluid, thus equalizing the pressure. Very quickly, the pump responds and the pressure is totally constant again.

In order to further maintain the uniformity of operation of the present system, nozzles 166 of the spray bar are preferably made of hardened material and are also replaceable so that after a period of use in spraying corrosive or abrasive fluids, new nozzles may be attached to the spray pipe.

OPERATION

In use of the apparatus of the present invention, switch 140 is closed and varible volume pump 120 is actuated by an electric motor or gasoline engine. The pressure controlled hydraulic fluid leaves the hydrostatic transmission 120 and travels through hydraulic line 116 to the 4-way, two position, solenoid actuated, spring return directional control valve 114. In the position shown in FIG. 1, the hydraulic fluid proceeds through directional control valve 114 into hydraulic line 110 and through conduit 106 into hydraulic cylinder 62, thus forcing the main piston shaft comprising portions 50 and 52 downwardly, together with diaphragm piston plates 38, 40 and diaphragms 34, 36. This action creates a vacuum in top chamber 42, holding outlet valve 94 tightly closed, while opening up inlet valve 78. Thus fluid to be pumped moves along pipe 152 into pipe 154, through open valve 158 and into pumping chamber 42. While this is taking place, the exact opposite is happening in lower pumping chamber 44. Inlet valve 80 is tightly sealed against wear ring 84, outlet valve 96 opens up and pumped fluid moves out through outlet pipe 162.

As the piston completes its travel to the bottom of hydraulic cylinder 62, the progressively enlarged shaft portion 68 engages and closes normally open microswitch 126, causing current to flow through wire 134 to the coil of relay 130. The energized coil pulls in the contact 131 of the relay allowing current to flow through wires 142 and 132. Normally closed microswitch 122 at this time is "closed", thus "latching in" the circuit even when the pump changes direction and the enlarged portion 68 of portion 52 is not in engagement with normally opened microswitch 126.

Current traveling through wire 142 energizes directional control valve 114, causing it to switch hydraulic fluid from port 144 to 146. The pressure controlled hydraulic fluid is then directed to hydraulic line 112 and conduit 108, which in turn forces the main shaft portions 50 and 52 upwardly, and the opposite action to that previously described is effected. At the completion of this stroke, normally closed microswitch 122 is opened (as shown in FIG. 1), thus dropping out the electric signal, whereby the flow of hydraulic fluid through the directional flow valve is switched back to port 144.

This back and forth reciprocating motion of the main shaft and piston is repeated and, since it is electrically controlled, the response time is much quicker than with air and hydraulic valves heretofore used. In the case where the materials being pumped are also being sprayed, this faster response time yields a more constant pumped fluid output.

Despite the use of microswitches, with their resultant faster response time, there is still a drop in the pump's output fluid pressure for a millisecond or two as the pump changes direction. To compensate for this pressure drop, expansion tank 170 is provided, which minimizes any fluid drop which might otherwise occur and avoids surges in the output line.

It is very important to maintain an even spray pattern when spraying any coating, but it is very hard to do so when spraying abrasi.ve materials such as the abrasive slurry used in sealing asphalt surfaces, since these materials are constantly wearing the "wetted" system part. It is for this reason that the present system includes a pressure compensated variable volume pump which continuously checks the pump's output hydraulic fluid pressure and will supply hydraulic fluid flow to maintain the "set" pressure. With the pressure compensated variable volume pump, even flow pressure is obtained even as nozzles 166 wear and, if valve 168 is closed, the operation of the diaphragm will be halted. Therefore, no relief valve is necessary as in most other positive displacement pumps.

The dual-acting diaphragm pumping system of the present invention employs parts which can be readily and economically manufactured and which are extremely rugged and durable. Also, by selecting materials for the so-called "wetted" parts of the pumping chambers, the apparatus may be adapted for pumping a wide variety of abrasive and corrosive materials including the spraying of suspended solids up to ¾" in diameter.

It is to be understood that various changes may be made in the system of the present invention such as piping up each end of the pump separately, thereby making two single-acting diaphragm pumps, pumping two different fluids at the same volume, but not at constant flow rates and running several pumps of the present design off one pressure compensated hydrostatic transmission. Various other changes may be made within the scope of the appended claims.

What is claimed is:

1. A system for pumping fluid materials comprising (a) a dual-acting diaphragm pump comprising spaced housings having flexible diaphragms for dividing the housings into pumping and back chambers (b) inlet and outlet valved openings in communication with each of said pumping chambers (c) inlet lines and outlet lines connected to said inlet and outlet valved openings (d) a hydraulic cylinder and piston interposed between said housings (e) a piston shaft extending between said diaphragms and engaged with opposed faces of said piston (f) hydraulic means engaged with opposite ends of said hydraulic cylinder for activating said piston and piston shaft (g) a directional control valve connected to said hydraulic means for alternately supplying hydraulic fluid to opposite ends of said hydraulic cylinder to effect reciprocating movement of said piston shaft and resultant movement of said flexible diaphragms to draw the fluid material into, and then expel the fluid material from, said pumping chambers (h) a pressure compensated variable volume pump connected with said hydraulic means and said directional control valve for maintaining constant output pressure of the pumped fluid material (i) power means for activating said variable volume pump (j) an expansion tank connected to, and mounted above, said outlet line for minimizing the drop in the pressure of the pumped fluid material, and (k) electrical means for operating said directional control valve to reverse the direction of flow of hydraulic fluid through said directional control valve and effect reversal in the direction of movement of said piston shaft to alternate the discharge of fluid materials from said pumping chambers.

2. The system of claim 1, wherein (a) said electrical means includes microswitches proximate the opposite ends of said hydraulic cylinder (b) a portion of microswitches engaging said piston shaft (c) portions of said piston shaft on each side of said piston being progressively enlarged for effecting movement of said microswitches to alternately close and open the microswitches to effect activation and deactivation of said directional control valve, and (d) a source of electrical power in circuit with said directional control valve and said microswitches.

3. The system of claim 1, with the addition of (a) a spray pipe having a plurality of hardened replaceable nozzles connected to said outlet line.

4. The system of claim 1, with the addition of (a) drain openings in the back chambers of said housings through which any fluid material leaking into the back chamber may escape.

5. The system of claim 1, with the addition of (a) hardened, replaceable wear rings around the inlet and outlet valved openings in said housings.

6. Apparatus for spraying fluid material comprising (a) a dual acting diaphram pump comprising spaced housings having a flexible diaphrams for dividing the housings into pumping and back chambers (b) inlet and outlet valved openings in communication with each of said pumping chambers (c) inlet lines and outlet lines connected to said inlet and outle valved openings (d) a hydraulic cylinder and piston interposed between said housing and said hydraulic cylinder including coaxially disposed flared recesses at opposed ends of said cylinder (e) a piston shaft extending between said diaphrams and engaged with opposed faces of said piston (f) hydraulic means engaged with said opposte ends of said hydraulic cylinder for activating said piston and piston shaft (g) a directional control valve connected to said hydraulic means for alternately supplying hydraulic fluid to said opposete ends of said hydraulic cylinder to effect reciprocating movement of said piston shaft and resultant movement of said flexible diaphrams to draw the fluid material into, and then expel the fluid material from, said pumping chambers (h) pressure control means connected with said hydraulic means and said directional control valve for maintaining constant output pressure of the pump fluid material (i) power means for activating said pressure control means (j) an expansion tank connected to, and mounted above, said outlet line for minimizing the drop in the pressure of the pumped fluid material (k) electrical means for operating said directional control valve to reverse the direction of flow of hydraulic through said directional control valve and effect reversal in the direction of movement of said piston shaft to alternate the discharge of fluid material from said pumping chambers (l) said electrical means includes microswitches having a portion thereof disposed within said flared recesses of said hydraulic cylinder (m) a portion of said microswitches engaging said piston shaft (n) portions of said piston shaft contiguous said piston being progressively enlarged for effecting movement of said microswitches to effect activation and deactivation of said direction control valve and cooperating with said flared recesses and adapted for being received within said flared recess for thereby permitting said piston shaft to bottom against said cylinder opposite ends (o) a source of electrical power in circuit with said directional control valve and said microswitches, and (p) a spray pipe having at least one nozzle connected to said outlet pipe through which the fluid material is sprayed onto a surface.

7. The apparatus of claim 6, wherein (a) said pressure control means is a variable volume pump of the pressure compensated type.

8. The apparatus of claim 7 with the addition of (a) hardened replaceable wear rings around the inlet and outled valved openings in said housings.

9. The apparatus of claim 8, wherein (a) a plurality of nozzles made of hardened material are connected to said spray pipe.

* * * * *